US005351359A

United States Patent [19]

Golden

[11] Patent Number: 5,351,359

[45] Date of Patent: Oct. 4, 1994

[54] ANCHOR CHAIN CLEANING DEVICE

[76] Inventor: Michael H. Golden, 339 Bayside Rd., Bellingham, Wash. 98225

[21] Appl. No.: 129,467

[22] Filed: Sep. 30, 1993

[51] Int. Cl.[5] ..... B63B 59/00

[52] U.S. Cl. ..... 15/256.6; 15/160; 15/220.4; 114/221 A

[58] Field of Search ..... 15/210.1, 220.4, 256.6, 15/160; 114/221 A

[56] References Cited

U.S. PATENT DOCUMENTS

| | | | |
|---|---|---|---|
| 1,950,959 | 3/1934 | Winsette | 15/256.6 X |
| 3,791,330 | 2/1974 | Haddad | 114/221 A |
| 4,291,432 | 9/1981 | Cogswell | 15/160 |
| 4,542,555 | 9/1985 | Lundin | 15/256.6 |
| 4,543,683 | 10/1985 | Goldman | 15/256.6 |

*Primary Examiner*—Edward L. Roberts
*Attorney, Agent, or Firm*—J. Robert Cassidy

[57] ABSTRACT

A cleaning device 20 for cleaning a boat's deployed anchor chain 14, or for cleaning ropes, lines or similar items, and having: i) a generally O-shaped handle 21 having a central through opening 22 for permitting the user to grasp the handle 21, and at least two smaller through openings 24, 25 adjacent its opposite ends for permitting removable connection to a conventional boat hook 52 or to a retrieval line 26 and weight 29; ii) a pair of spaced, laterally projecting, generally cylindrical coaxial anchor chain guides 35, 36 rigidly secured to respective ones of the opposite ends of the handle 21, each having a longitudinally extending radial opening 39, 42 extending in different angular directions from the axis extending therethrough; and iii), a flexible, brush-like scrubbing medium 49, 50 bonded to the inner cylindrical surfaces of the anchor chain guides 35, 36 and having a plurality of cleaning bristles 50 extending radially inward towards, but terminating short of, the axis extending through the coaxial chain guides 35, 36. In the illustrative device 20, the scrubbing medium 49, 50 comprises a flexible grass-like polyethylene material consisting of a flexible backing 49 and a plurality of upright bristles 50 embedded therein. Reciprocation of the device while mounted on a deployed anchor chain 14 extending coaxially through the chain guides 35, 36 serves to clean the anchor chain 14.

8 Claims, 4 Drawing Sheets

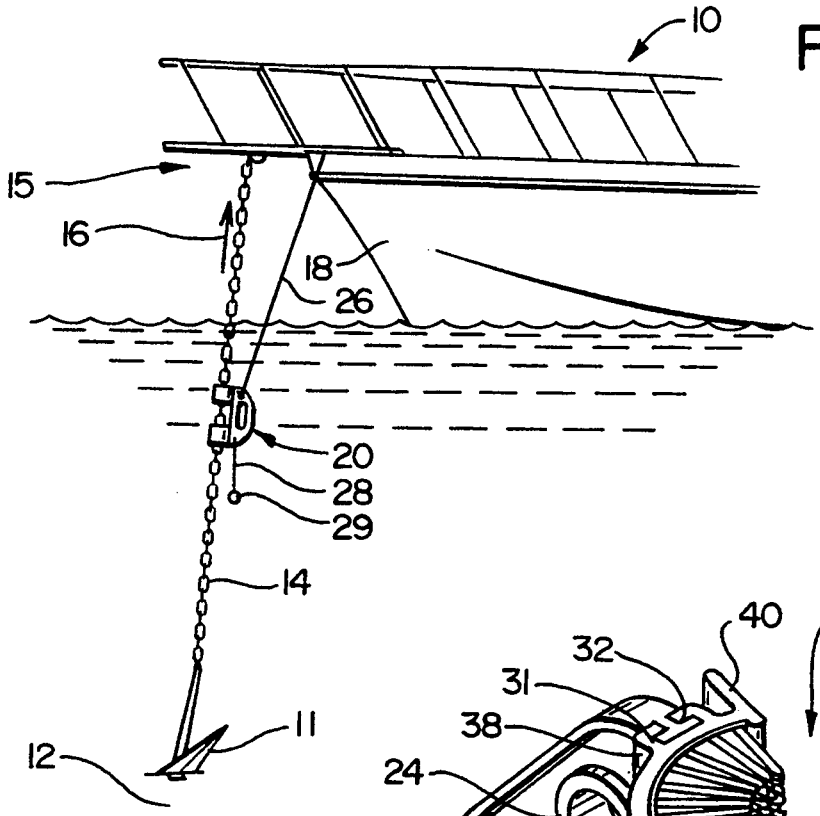
FIG. 1
FIG. 2
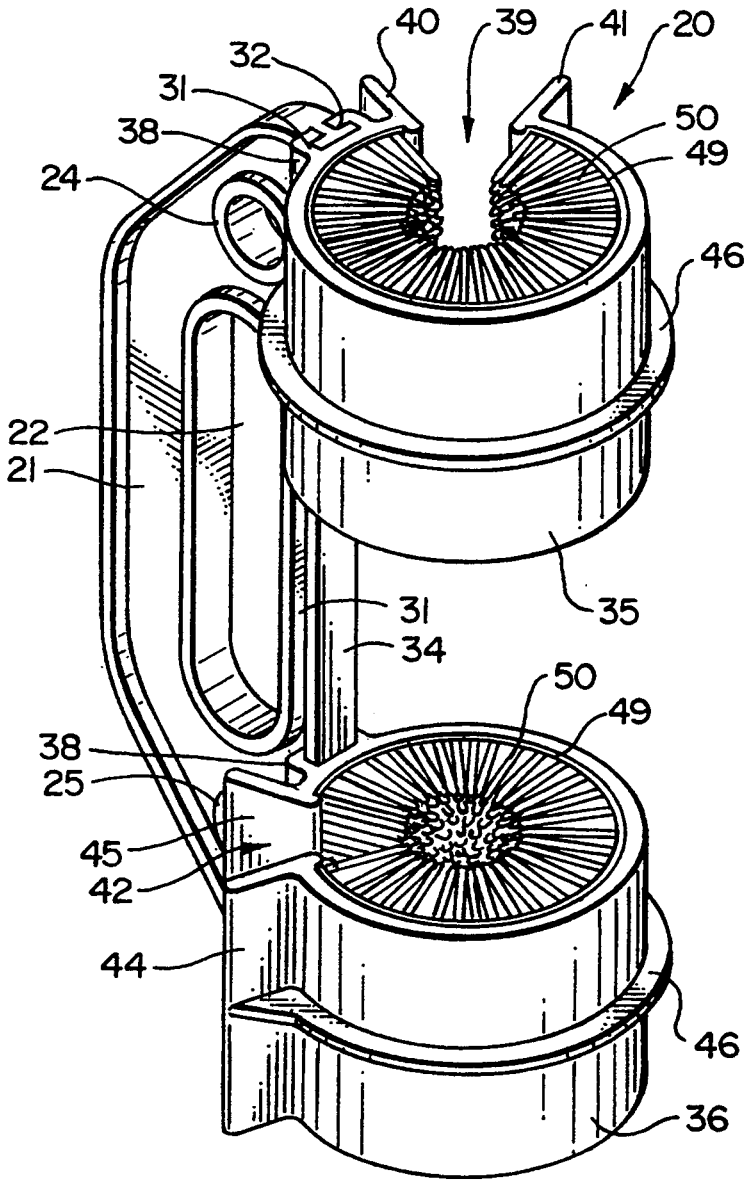

ANCHOR CHAIN CLEANING DEVICE

BACKGROUND OF THE INVENTION

1. Technical Field

The present invention relates generally to a cleaning device; and, more particularly, to a cleaning device adapted to clean a boat's deployed anchor chain, a rope or line, or similar item.

More specifically, the present invention relates to a cleaning device which is readily attached to, and detachable from, a boat's deployed anchor chain or the like in surrounding relation thereto; and, which can be reciprocated therealong beneath the surface of the water so as to scrub and clean the individual chain links prior to retrieval of the anchor and its anchor chain. To this end, the cleaning device of the present invention includes: i) a generally O-shaped handle having a central through opening for permitting the user to grasp the handle, and at least two smaller through openings adjacent its opposite ends for permitting removable connection to a conventional boat hook or to a nylon retrieval line and a weight; ii) a pair of spaced, laterally projecting, generally cylindrical, coaxial anchor chain guides rigidly secured to respective ones of the opposite ends of the handle, each having a longitudinally extending radial opening formed therein extending in different angular directions from the axis extending therethrough; and iii), a flexible, brush-like, scrubbing medium bonded to the inner cylindrical surfaces of the anchor chain guides and having a plurality of cleaning bristles extending radially inward towards the axis extending through the coaxial anchor chain guides.

In the illustrative form of the invention, the entire assembly is preferably formed of a rigid, light-weight, buoyant material having excellent wear-resistance characteristics such, for example, as polyethylene or polypropylene; and, consistent therewith, the brush-like scrubbing medium preferably comprises a simulated grass-like structure having a flexible plastic backing and a plurality of closely spaced, generally parallel, upstanding plastic bristles. A material that has proven particularly suitable for this purpose is ASTROTURF® and, more specifically, an ASTROTURF® product marketed as FLAIR® doormatting material—ASTROTURF and FLAIR are registered trademarks of Monsanto Company of St. Louis, Mo. Because all of the material employed is buoyant, cleaning devices made therefrom are highly advantageous when used in a marine environment since they will float if inadvertently dropped into the water during attachment to or removal from a boat's deployed anchor chain.

2. Background Art

The problems associated with retrieval of dirty fouled anchor chains is one of long standing and which has been found particularly vexing to boaters. Not only is a dirty fouled anchor chain slippery and difficult to handle manually, but, moreover, the mud, slime, seaweed and other materials tend to fleck off the anchor chain as it is retrieved, fouling the boat's hull, deck, chain locker, etc. requiring time-consuming cleanup procedures.

Because of this long standing problem, it has been proposed in Winsette U.S. Pat. No. 1,950,959 issued in 1934 to use an anchor chain scrubber fabricated from a weighted metal rod or the like to which are attached a pair of circular frames having scrubbing members formed of stiff straws, metal spines or other suitable scrubbing material detachably secured thereto by bolts, screws or the like. The circular frames are provided with longitudinally extending openings rotatively displaced one from the other so as to permit the anchor chain to be inserted therethrough. Since the scrubbing device is fabricated from, at least in substantial part, metal components, and since it is weighted at one end, it tends to sink below the surface of the water when attached to the anchor chain, and it can be pulled upwardly by means of a supporting line, lanyard, or chain so as to impart a reciprocating scrubbing action as the scrubber moves gravitationally downward and is pulled upward along the anchor chain. Unfortunately, however, the Winsette anchor chain scrubber has a number of disadvantages attributable to the metallic materials used in its assembly.. Thus, it is heavier than water and can easily be lost overboard during attempts to attach it to and/or remove it from the anchor chain. Additionally, the bolts and/or screws used to attach the scrubbing members are likely to score the anchor chain and/or the hull of the boat; and, the metal components are subject to corrosion and rust.

More recently, U.S. Pat. No. 4,291,432 issued to Arthur R. Cogswell has disclosed the use of a sinuous brush which can be attached to the hook end of a conventional boat hook with the brush being designed so that it twists around the anchor chain as it is reciprocated therealong by manual movement of the boat hook.

Other prior art patents of miscellaneous interest include: U.S. Pat. Nos. 3,791,330—Haddad [a sponge mounted on a hinged V-shaped support for cleaning boat stays]; 4,543,683—Goldman [a housing having an internal brush adapted to be moved along boat stays]; and, 4,542,555—Lundin [a device having radially collapsible fingers adapted to engage an oil covered rope for stripping the oil therefrom].

SUMMARY OF THE INVENTION

The present invention provides a simple, light weight, buoyant scrubbing device for anchor chains, ropes, lines and similar items, in which the scrubbing device: i) is devoid of metal parts including, but not limited to, threaded fasteners; ii) can be easily snapped onto and snapped off of a deployed anchor chain; and iii), can be easily reciprocated along the deployed anchor chain to scrub and clean the chain by employment of either a conventional boat hook or with a retrieving line and attached weight. Since the scrubbing device of the present invention is formed of light weight buoyant material, it will float if inadvertently dropped into the water during attachment to and/or removal from the anchor chain. And, since the scrubbing device is devoid of metallic fasteners and sharp metal edges, it will not damage either the anchor chain or the boat's hull when in use. The device may be easily molded of light weight synthetic polyethylene or polypropylene materials and, when assembled, comprises an integral, unitary, one-piece assembly devoid of separate fasteners.

To this end, the cleaning device of the present invention comprises: i) a molded O-shaped plastic handle having through openings formed therein to permit grasping by hand and attachment of a boat hook and/or retrieval line and weight; ii) a pair of spaced, generally cylindrical, coaxial anchor chain guides having longitudinally extending radial openings therein which are circumferentially offset from one another; and iii), a scrubbing medium, preferably formed of an ASTROTURF® material such as FLAIR® doormatting, permanently affixed to the interior surfaces of the generally cylindrical anchor chain guides. All components of the cleaning device are preferably formed of a light weight synthetic material such, for example, as polyethylene or polypropylene, characterized by its strength, wear resistance and buoyancy.

More specifically, it is an object of the present invention to provide a cleaning device suitable for scrubbing a boat's deployed anchor chain, ropes, lines and similar items wherein the scrubbing device is economical, buoyant, devoid of projecting fasteners and/or sharp edges, and is easily applied to, reciprocated along, and removed from the boat's deployed anchor chain or a rope, line or the like.

DESCRIPTION OF THE DRAWINGS

These and other objects and advantages of the present invention will become more readily apparent upon reading the following Detailed Description and upon reference to the attached drawings, in which:

FIG. 1 is a fragmentary side elevational view, here illustrating the bow of a boat with its anchor and anchor chain deployed, and with a cleaning device embodying features of the present invention attached at the free end of a retrieving line and mounted in surrounding relation to the anchor chain beneath the surface of the water;

FIG. 2 is an enlarged isometric view of the exemplary cleaning device of the present invention shown in FIG. 1;

Figure 3:
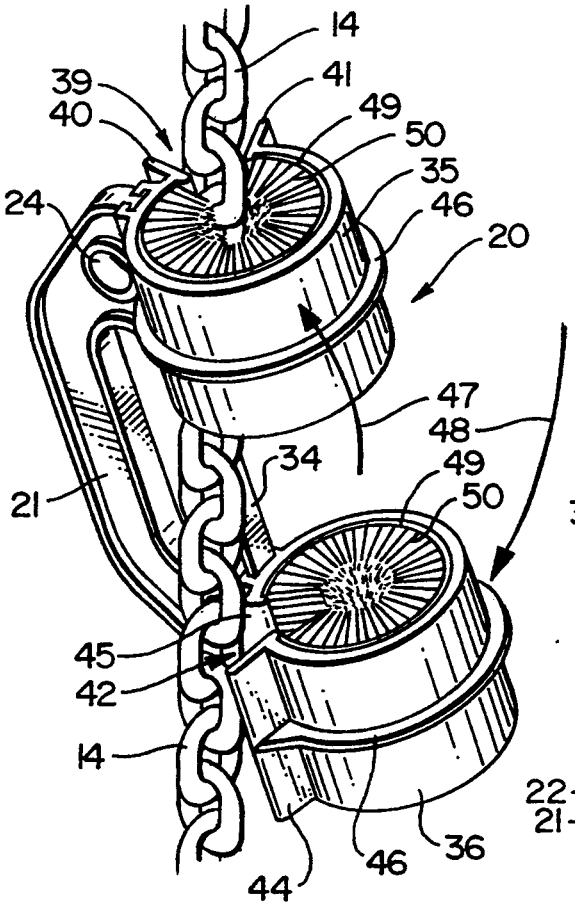
FIG. 3 is a fragmentary isometric view here depicting attachment of the cleaning device shown in FIG. 2 to a deployed anchor chain.

While the invention is susceptible of various modifications and alternative forms, specific embodiments thereof have been shown by way of example in the drawings and will herein be described in detail. It should be understood, however, that it is not intended to limit the invention to the particular forms disclosed; but, on the contrary, the intention is to cover all modifications, equivalents and/or alternatives falling within the spirit and scope of the invention as expressed in the appended claims.

DETAILED DESCRIPTION

Turning now to the drawings, and directing attention first to FIG. 1, it will be noted that a boat, generally indicated at 10, is here anchored by means of a small anchor 11 embedded in the bottom 12 with the anchor 11 being attached to the lower free end of a suitable anchor chain 14 trained upwardly and over the bow, generally indicated at 15, of the boat. As will be apparent to persons skilled in the art, when the boatsman desires to retrieve the anchor 11, the anchor chain 14 will be pulled upwardly, either manually or by means of any suitable power-driven winch or capstan (not shown), in the direction indicated by the arrow 16; with the retrieved anchor chain 14 preferably being stowed in a chain locker (not shown) in the boat's foredeck. As experienced boaters will also recognize, retrieval of the anchor 11 and anchor chain 14 is often accompanied by a considerable amount of mud, slime, seaweed and like materials which tend to cling to the anchor chain 14 and which, therefore, tend to foul and contaminate the boat's hull 18, deck 19 and chain locker (not shown).

In order to resolve this problem, the present invention contemplates an anchor chain cleaning device, generally indicated at 20 in FIG. 1 and which is best shown in FIG. 2, which serves to scrub, and therefore clean, the anchor chain 14 beneath the surface of the water either prior to or during retrieval of the anchor 11 and chain 14. In the exemplary form of the invention here depicted, the illustrative cleaning device 20 comprises an O-shaped handle 21, best viewed by reference to FIGS. 2 and 4 conjointly, having: i) a large central opening 22 so as to permit the boater to grasp the device with his/her hand (not shown) and; ii), a pair of upper and lower openings 24, 25 respectively, adapted to receive respective ones of a retrieval line 26 and a weight line 28 attached to a suitable lead weight 29 or the like which may weigh on the order of up to one or two pounds, or adapted to receive the hook end of a conventional boat hook (not shown in FIGS. 1 through 4). In the exemplary device, one of the openings 24, 25 is preferably about three-quarter inches ($\frac{3}{4}''$) in diameter, while the other is preferably about five-eighths inches ($\frac{5}{8}''$) in diameter so as to permit accommodation of boat hooks of varying sizes. As best observed in FIG. 2, it will be noted that the handle 21 is provided with a pair of longitudinally extending grooves 31, 32 respectively formed on opposite sides of the handle 21 adjacent one edge 34 thereof.

In carrying out the present invention, the exemplary cleaning device 20 is provided with a pair of spaced, generally cylindrical, anchor chain guides 35, 36 each having an external, longitudinally extending, C-shaped mounting flange 38 adapted to be snugly mounted in the grooves 31, 32 on the handle 21. Any suitable means (not shown) can be employed for fixedly mounting the anchor chain guides 35, 36 at fixed spaced positions along the edge 34 of the handle 21. For example, the guides 35, 36 may be adhesively bonded in place; they may be secured in place by countersunk rivets or fasteners; or, a conventional detent type latching mechanism may be employed for this purpose.

Figure 5:
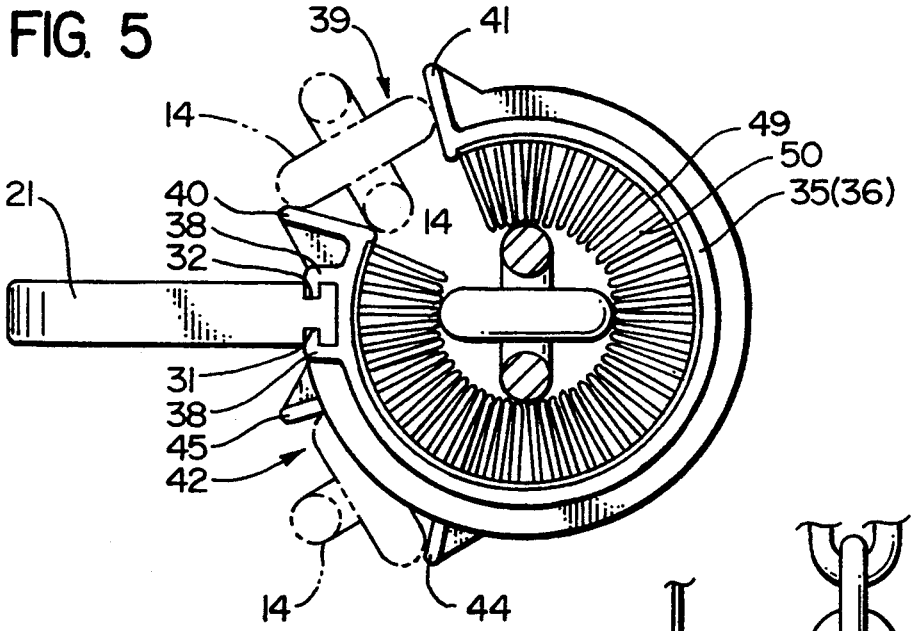
FIG. 5 is a plan view, partly in section, here illustrating attachment of the cleaning device of the present invention to an anchor chain, shown in phantom at the points where it enters into and exits from the cleaning device, and in solid lines when coaxially centered within the cleaning device.

In order to permit removable mounting of the anchor chain guides 35, 36 on the anchor chain 14, and as best shown by reference to FIGS. 2, 3 and 5 conjointly, it will be observed that guide 35 is provided with a longitudinally extending radial opening, generally indicated at 39, defined by longitudinally extending, outwardly flared, chain guide flanges 40, 41; while guide 36 is similarly provided with a longitudinally extending radial opening, generally indicated at 42, defined by longitudinally extending, outwardly flared, chain guide flanges 44, 45. Preferably the longitudinally extending radial openings 39, 42 on respective ones of the guides 35, 36 are disposed on opposite sides of the C-shaped mounting flange 38 as best shown by reference to FIGS. 2 and 5 where it will be observed that when viewed on end, as in FIG. 5, guide flanges 40, 41 defining radial opening 39 are disposed at the 10:30 clock position as viewed in the drawing, the C-shaped mounting flange 38 is disposed at the 9:00 clock position; and, the guide flanges 44, 45 defining radial opening 42 are disposed at the 7:30 clock position. A stiffening flange 46 is provided which extends circumferentially around each of the guides 35, 36 between the flared flanges 40, 41 on guide 35 and the flared flanges 44, 45 on guide 36; thereby strengthening the molded guides 35, 36 while, at the same time, permitting some flexure or springiness of the guides during usage.

The foregoing arrangement insures that the cleaning device 20 may be easily snapped into position on the anchor chain 14 in the manner shown in FIG. 3—i.e., guide 35 is moved from right foreground to left background as viewed in the drawing and as indicated by arrow 47 so as to center the anchor chain 14 coaxially within guide 35; with guide 36 being moved laterally from right background to left foreground as indicated by arrow 48 so as to center the anchor chain 14 coaxially within guide 36. The arrangement further tends to insure that the cleaning device 20 remains on the anchor chain which extends coaxially through the guides 35, 36 during usage and until deliberately removed by the user by snapping the anchor chain guides 35, 36 in directions opposite to those shown by arrows 47, 48 in FIG. 3.

In carrying out the invention, the three structurally rigid components of the cleaning device 20 described above—viz., the handle 21 and the generally cylindrical anchor chain guides 35, 36—are preferably molded from a synthetic material, such as polyethylene or polypropylene, characterized by its strength, rigidity, lightness in weight and buoyancy.

In accordance with one of the important aspects of the present invention, the internal surfaces of the generally cylindrical anchor chain guides 35, 36 are preferably lined with a synthetic plastic material comprising a backing member 49 and a plurality of upstanding, vertical, grass-like bristles 50. Excellent results have been observed using a Monsanto ASTROTURF® material preferably marketed for use as FLAIR® doormatting material and made from polyethylene. Thus, the arrangement is such that when the backing member 49 is adhesively bonded to the interior cylindrical surfaces of the generally cylindrical anchor chain guides 35, 36, the upstanding bristles 50 project radially inward towards, but terminate short of, the longitudinal axis passing through the guides 35, 36.

Figure 4:
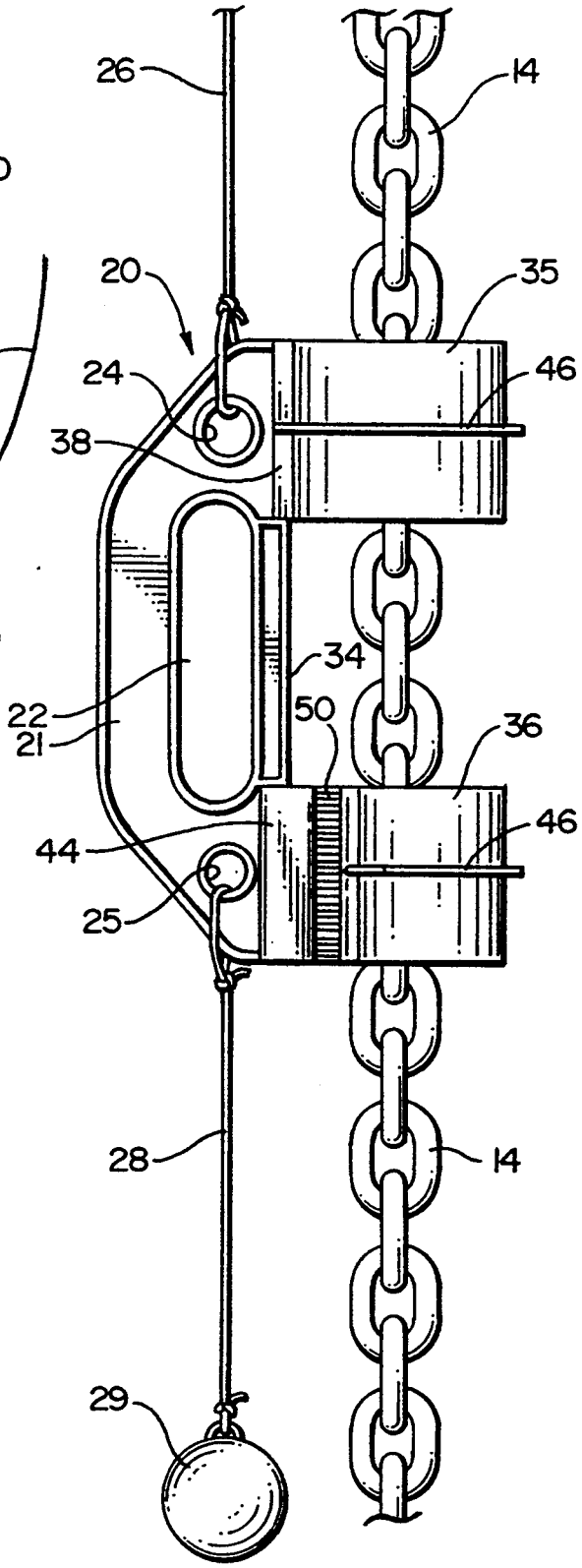
FIG. 4 is a fragmentary side elevational view depicting one arrangement for causing reciprocating movement of the cleaning device of the present invention along an anchor chain as a result of gravitational downward movement attributable to a weight attached to the cleaning device and upward movement resulting from inboard movement of the retrieving line.
Figure 6:
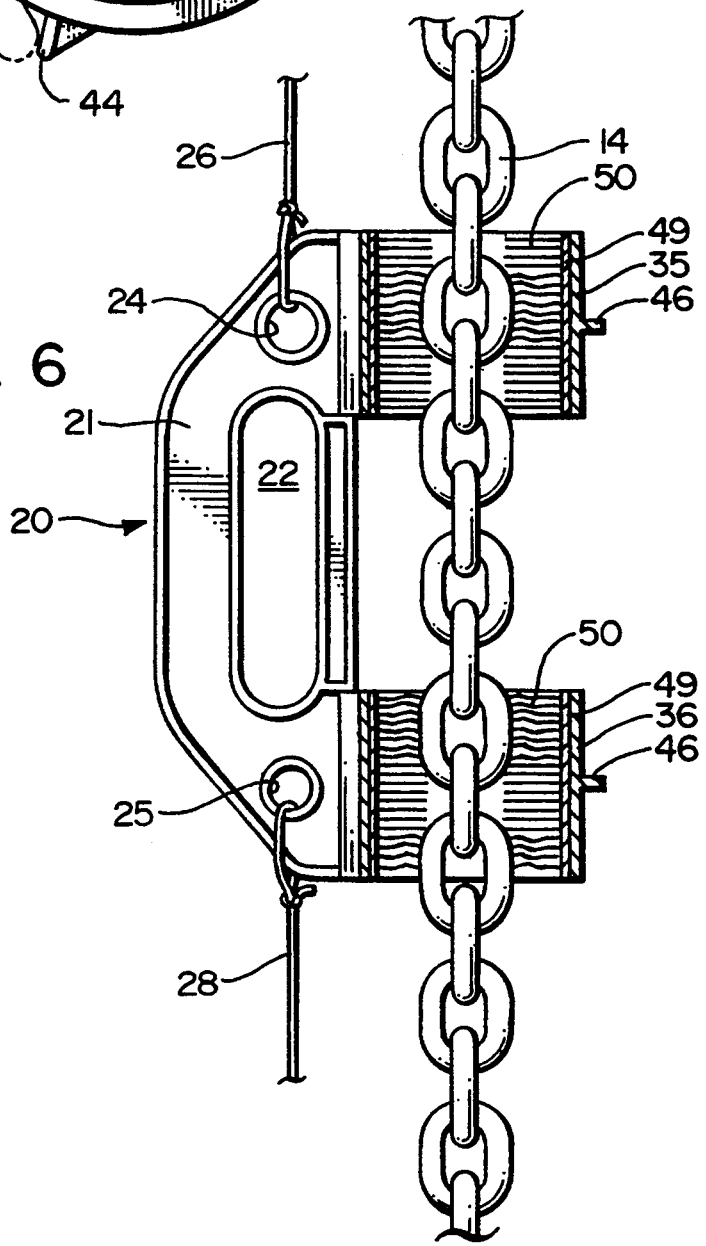
FIG. 6 a fragmentary side elevational view, partly in section, similar to FIG. 4, but here depicting co-action between the scrubbing bristles of the cleaning device and the individual links of the anchor chain.

In use, and as best illustrated by reference to FIGS. 4 and 6 conjointly, it will be appreciated that gravitational forces particularly attributable to the weight 29 (FIG. 4) will cause the cleaning device 20 to move downwardly along the anchor chain 14, preferably when positioned below the surface of the water, as the retrieving line 26 is paid out. On the other hand, inboard pulling of the retrieving line 26 will cause the cleaning device to move upwardly along the anchor chain 14. Thus, as the cleaning device 20 is reciprocated upwardly and downwardly over a given section of the anchor chain 14, that section is aggressively scrubbed by the plastic bristles 50, thereby cleaning the chain. This can be done immediately prior to and/or during retrieval of the anchor 11 and the anchor chain 14.

Figure 7:
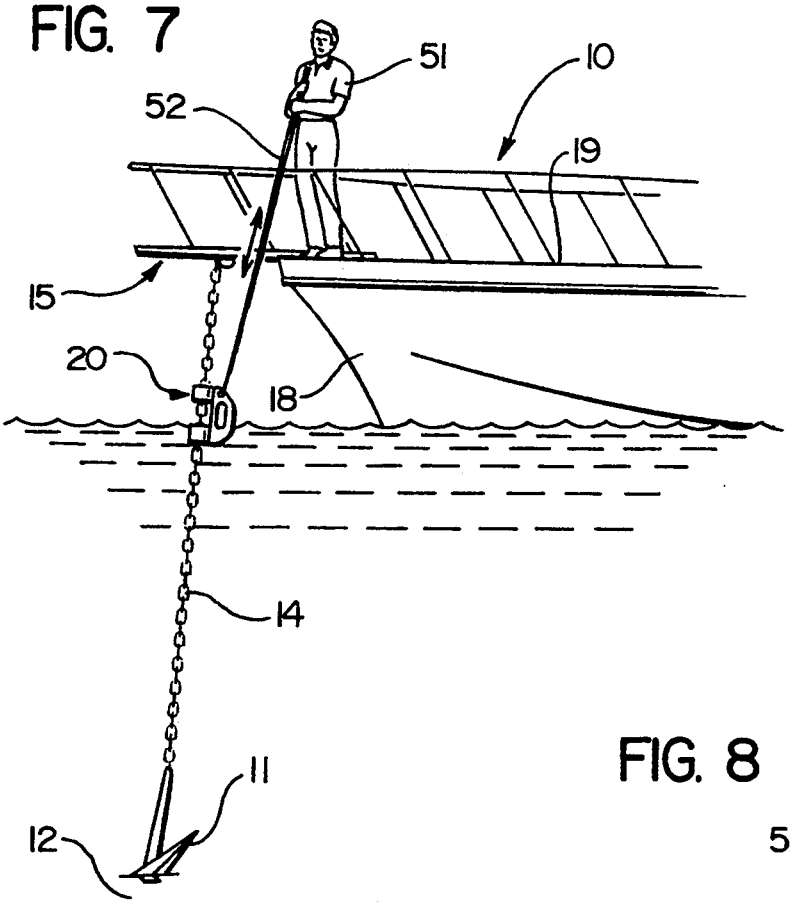
FIG. 7 is a fragmentary side elevational view similar to FIG. 1, but here illustrating a crew member cleaning a deployed anchor chain by reciprocating the cleaning device made in accordance with the present invention using a conventional boat hook to move the cleaning device upwardly and downwardly along the chain links; and, FIG. 8 is a fragmentary side elevational view, partly in section, here depicting the manner in which the conventional boat hook is attached to the cleaning device.
Figure 8:
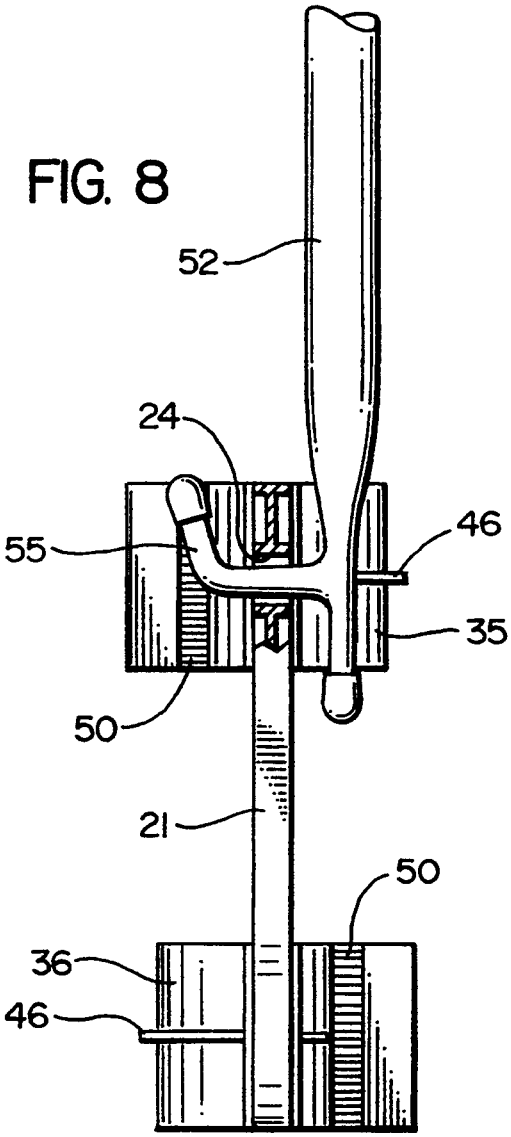

Referring next to FIGS. 7 and 8, a slightly modified manner of using the exemplary anchor chain cleaning device 20 of the present invention has been depicted. Thus, as here shown, a crew member 51 (FIG. 7) is rapidly reciprocating a conventional boat hook 52 as generally indicated by the arrow 54 depicted in FIG. 7. The hook 55 on the lower end of the boat hook 52 is coupled directly to the cleaning device 20 by passing the hook 55 through one of the openings 24, 25—here the opening 24—formed in the handle 21; and, consequently, as the crew member 51 reciprocates the boat hook 52, the cleaning device 20 is rapidly reciprocated up and down relative to the anchor chain 14, thus serving to effectively scrub the same and remove virtually all mud, slime, seaweed and other contaminating materials from the anchor chain 14 prior to bringing the chain on board for stowage in a chain locker (not shown).

Those skilled in the art will appreciate from the foregoing description that there has herein been disclosed a simple, yet effective, low cost scrubbing device for boat anchor chains which may readily be molded from plastic parts and assembled into a light-weight, buoyant, rigid, integral tool devoid of separate fasteners, sharp metallic edges and/or other metallic components which are subject to rust and corrosion when used in marine environments and which can score or otherwise damage the anchor chain 14 and/or the boat's hull 18 and/or deck 19. The tool readily permits of easy fabrication in a wide range of sizes to accommodate different sized anchor chains, ropes, lines and the like; and, may be made from readily available commercial materials characterized by their durability and wear-resistance characteristics.

I claim:

1. A light weight buoyant anchor chain cleaning device adapted to be removably attached to, and reciprocated along, a deployed anchor chain, rope, line and the like for cleaning the same, said anchor chain cleaning device comprising, in combination:

a) a generally O-shaped handle formed of non-metallic material and having at least one generally linear elongate edge;

b) said handle having access openings extending therethrough permitting grasping of said handle by the user's hand and attachment of said handle to at least one of a boat hook and/or a retrieval line/-weight combination;

c) first and second generally cylindrical anchor chain guides formed of non-metallic material secured to said generally lineal elongate edge on said handle in spaced apart coaxial relation;

d) said first generally cylindrical anchor chain guide having a first longitudinally extending radial opening extending therethrough and oriented adjacent a plane passing through said handle and said first and second coaxial chain guides and disposed laterally to one side of the plane;

e) said second generally cylindrical anchor chain guide having a second longitudinally extending radial opening extending therethrough and disposed laterally of the plane extending through said handle and said first and second coaxial chain guides on the side of the plane opposite the side where said first longitudinally extending radial opening is disposed; and, f) a scrubbing medium comprising a flexible backing member of non-metallic synthetic material and a plurality of non-metallic synthetic upstanding bristles embedded in said flexible backing member, said scrubbing medium being bonded to the internal surfaces of said first and second generally cylindrical chain guides so that said bristles extend radially inward towards, but terminate short of, the longitudinal axis extending through said coaxial first and second chain guides.

2. A light weight buoyant anchor chain cleaning device as set forth in claim 1 wherein said handle, said first and second generally cylindrical chain guides, and said scrubbing medium are formed of a synthetic plastic material such as polyethylene and polypropylene.

3. A light weight buoyant anchor chain cleaning device as set forth in claim 2 wherein said scrubbing medium comprises a conventional artificial turf-like material.

4. A light weight buoyant anchor chain cleaning device as set forth in claim 1 wherein said scrubbing medium comprises a conventional artificial turf-like material.

5. A light weight buoyant anchor chain cleaning device as set forth in claim 1 wherein said handle includes first and second opposed longitudinally extending grooves formed on opposite sides of said handle adjacent said one generally lineal elongate edge; and, said first and second generally cylindrical chain guides each include an integral, longitudinally extending, C-shaped mounting flange formed on the outer surface thereof for fixedly mounting said first and second chain guides in spaced apart coaxial relation along said one generally lineal edge of said handle with said C-shaped flange lockingly engaged with said first and second opposed grooves formed in said handle.

6. A light weight buoyant anchor chain cleaning device as set forth in claim 1 wherein said first and second longitudinally extending radial openings formed in respective ones of said first and second generally cylindrical chain guides are defined by pairs of longitudinally extending, outwardly flared, circumferentially spaced flanges formed on and integral with each of said first and second generally cylindrical anchor chain guides.

7. A light weight buoyant anchor chain cleaning device as set forth in claim 1 which, when mounted on a boat's deployed anchor chain, rope, line and the like extending coaxially through said first and second anchor guides, may be reciprocated therealong by means of a retrieval line attached to one end of said handle and a weight attached to the opposite end of said handle whereby said cleaning device travels downwardly along and relative to the anchor chain extending axially through said first and second anchor chain guides as a result of gravitational forces as the retrieval line is paid out and said cleaning device travels upwardly along and relative to the boat's deployed anchor chain as the retrieval line is pulled aboard the boat.

8. A light weight buoyant anchor chain cleaning device as set forth in claim 1 which, when mounted on a boat's deployed anchor chain, rope, line and the like extending coaxially through said first and second chain guides, may be reciprocated therealong to cause said scrubbing medium to engage and scrub the anchor chain by means of a boat hook attached to said handle and manually reciprocated by a member of the boat's crew.

* * * * *